US005083491A

United States Patent [19]

Fields

[11] Patent Number: 5,083,491

[45] Date of Patent: Jan. 28, 1992

[54] METHOD AND APPARATUS FOR RE-CREATING EXPRESSION EFFECTS ON SOLENOID ACTUATED MUSIC PRODUCING INSTRUMENTS

[75] Inventor: Kyle D. Fields, El Dorado Hills, Calif.

[73] Assignee: Burgett, Inc., Sacramento, Calif.

[21] Appl. No.: 708,892

[22] Filed: May 31, 1991

[51] Int. Cl.[5] ..... G10F 1/02; G10H 1/18

[52] U.S. Cl. ..... 84/21; 84/645; 84/658

[58] Field of Search ..... 84/19-22, 84/615, 626, 645, 658, 687-690, DIG. 7

[56] References Cited

U.S. PATENT DOCUMENTS 3,604,299 9/1971 Englund .
3,905,267 9/1975 Vincent .
4,132,141 1/1979 Campbell et al. .
4,135,428 1/1979 Campbell .
4,172,403 10/1979 Campbell et al. .
4,174,652 11/1979 Campbell .
4,176,578 12/1979 Campbell et al. .
4,351,221 9/1982 Starnes et al. .
4,419,920 12/1983 Ohe .
4,744,281 5/1988 Isozaki .

*Primary Examiner*—Stanley J. Witkowski
*Attorney, Agent, or Firm*—John P. O'Banion

[57] ABSTRACT

A method and apparatus for re-creating expression effects contained in musical renditions recorded in MIDI format for reproduction on solenoid actuated player piano systems. Detected strike velocity information contained in the MIDI recording is decoded and correlated to strike maps stored in a controlling microprocessor, the strike maps containing data corresponding to desired expression effects. Time differentiated pulses of fixed width and amplitude are directed to the actuating solenoids in accordance with the data in the strike maps, and the actuating solenoids in turn strike the piano strings. Thereafter, pulses of uniform amplitude and frequency are directed to the actuating solenoids to sustain the strike until the end of the musical note. The strike maps dynamically control the position of the solenoid during the entire duration of the strike to compensate for non-linear characteristics of solenoid operation and piano key movement, thus providing true reproduction of the original musical performance.

20 Claims, 2 Drawing Sheets

METHOD AND APPARATUS FOR RE-CREATING EXPRESSION EFFECTS ON SOLENOID ACTUATED MUSIC PRODUCING INSTRUMENTS

BACKGROUND OF THE INVENTION

1. Field of the Invention

This invention pertains generally to mechanically-driven musical instruments which reproduce pre-recorded music, and specifically to operation of solenoid actuators using digitally mapped pulse signals to re-create the expression effects in the original music.

2. Description of the Background Art

Methods and apparatus for recording and playing back music on mechanically-driven instruments such as pianos are well known. For example, U.S. Pat. No. 4,744,281 issued to Isozaki on May 17, 1988, discloses an automatic player piano system with an ensemble playback mode for decoding a piece of music having at least two data blocks, one data block corresponding to music to be reproduced by an electronic sound generator and the other corresponding to music to be reproduced by activating solenoids to strike piano strings. U.S. Pat. No. 4,419,920 issued to Ohe on Dec. 13, 1983, discloses an apparatus for recording and reproducing musical performances in which the recording comprises the image, the sound, and musical instrument performance data of a particular performance, the watcher-listener being able to see and hear the performance via a video playback and the automatic playing of an actual musical instrument. U.S. Pat. No. 4,351,221 issued to Starnes et al. on Sept. 28, 1982, discloses a player piano recording system which has photosensor flags secured to the underside of the piano keys, vertical movement of which is detected by horizontally adjustable photosensors to produce "key played" and key velocity signals which are supplied to a microprocessor for deriving expression signals for recording on magnetic tape. U.S. Pat. No. 3,905,267 issued to Vincent on Sept. 16, 1975, discloses an electronic player piano with record and playback features. U.S. Pat. No. 3,604,299 issued to Englund on Sept. 14, 1971, discloses a method and apparatus for recreating a musical performance using pulse streams applied to relays or other drivers.

It is important, however, not only to record the musical notes and timing for later playback on an instrument, but also to record the expression contained in the original work in order to re-recreate a more realistic performance. Examples of methods and apparatus for recording expression effects can be seen in U.S. Pat. No. 4,172,403 issued to Campbell et al. on Oct. 30, 1979, which discloses a method and apparatus for encoding expression data while recording from the keyboard of an electronic player piano wherein the intensity of the music being recorded is reflected in variations in the power of the acoustic waveform produced; U.S. Pat. No. 4,176,578 issued to Campbell et al on Dec. 4, 1979, which discloses a system for encoding of bass and treble expression effects in a digital data stream while recording from the keyboard of an electronic player piano; and U.S. Pat. No. 4,174,652 issued to Campbell on Nov. 20, 1979, which discloses a method and apparatus for recording digital signals for later actuating solenoids for re-creation of musical expression.

Essential to accurate reproduction of the original work is the capability to decode recorded expression information and direct that information to the instrument being used to re-create the original work. In a typical application such as a player piano system, solenoids or other drivers are actuated to strike the strings. Several techniques and devices have been developed in an attempt to achieve "true reproduction" as can be seen in U.S. Pat. No. 4,132,141 issued to Campbell et al. on Jan. 2, 1979, which discloses a solenoid-hammer control system for re-creating expression effects from recorded music in which a stream of pulses activates the solenoids, the width of the pulses being modulated so that the average drive energy applied to the solenoid is proportional to the desired intensity; and U.S. Pat. No. 4,135,428 issued to Campbell on Jan. 23, 1979 which discloses a pulse width modulation circuit for controlling the expression of an electronically controlled keyboard instrument by simultaneous adjustment of both the leading and trailing edges of pulses in a pulse stream without varying the rate of the pulses, the pulses switching a solenoid on and off at a rapid rate so that the energy applied to the solenoid varies and therefore the striking force of the piano is changed. These approaches, however, use pulse streams to actuate solenoids or other drivers which do not contain sufficient expression information to achieve "true reproduction" of the original work, even though they modulate the width of pulses to vary the average drive energy and striking force. Furthermore, they are not capable of compensating for non-linear travel of the solenoid plungers or the mass of the strike keys differing from instrument to instrument.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention overcomes the deficiencies heretofore described by providing dynamic control during the entire strike time of a solenoid coupled to the strike hammer in a player piano system. In order to fully appreciate the nature of the present invention, it is helpful to briefly discuss the operation of a solenoid actuated player piano.

Solenoid actuation of a piano key is a complex set of mechanical interactions. The mass of the key mechanism is accelerated by the magnetic force created in the solenoid. Since the force of the solenoid is non-linear because it changes as the plunger travels, and the mass of the key is non-linear because, when actuated, the key damper increases the mass of the key, in order to re-create music with true reproduction of expression effects the solenoid must be dynamically controlled during the entire period of the key strike.

Each of the eighty-eight keys on a typical player piano is actuated by a vertical solenoid working on the far end of the key. The solenoids are arranged so as to lift the end of the key, and thus accelerate the key mechanism and hammer to strike the string. The force produced by the solenoid is non-linear and can vary as much as 10 to 1 from the start to the end of the strike, the shape of the force curve varying according to the solenoid design and construction.

Each piano key includes a damper mechanism which can ride on the key to dampen the string after the strike.

The damper interaction takes effect at some point during the key travel, and thus throws an increased mass onto the key when it is engaged. In addition, the damper may be raised by the pianist so that it will not interact with the key, thus allowing the string to sustain after being struck by the hammer.

Each of the solenoid actuators typically consists of a wound coil housed in a steel frame. The solenoid plunger travels within the center of the winding, and exerts mechanical force to lift the piano key. Flexible rubber tips are used between the plunger push-rod and the bottom of the key to reduce the impact noise of the mechanism. However, this also introduces an additional non-linear component into the key travel.

In general terms, the present invention "maps" the travel of the solenoid into discrete steps of time, or intervals, the mapped information taking into account the foregoing non-linear characteristics of solenoid operation and key movement. Typically, one strike of the solenoid may contain over fifty such intervals. Each of these intervals is then selectively activated by a controlling microprocessor, the microprocessor determining the configuration of the map by analysis of various key interactions. The microprocessor, using instructions stored in memory, translates recorded musical information into driving signals for each solenoid, the object being to reproduce the recorded music as accurately as possible. Essentially, it is the velocity information contained in the recording which is processed into driving signals. Since velocity is the combination of force and mass, the microprocessor is able to determine the force of the solenoid at any given point in time and, in combination with the known key mass, determine the required change in force to produce the desired key acceleration and velocity.

The force required to accelerate the key can be substantial. Therefore, the present invention provides for a high power strike period, followed by a low power holding period. This allows maximum force during the critical strike period, while still allowing key hold down times without excessive power dissipation.

The present invention converts the recorded musical information into discrete driving signals representing strike velocity. The driving signals are then separated in strike signals and hold signals, the strike signals consisting of time differentiated pulses of fixed width and amplitude, the number and timing of said pulses being dependent upon the information in the drive map which controls the re-creation of the expression of the musical notes. The pulses are then directed to the solenoid which in turn causes the strike hammer to strike the piano string. When the strike period is over, a hold signal which comprises pulses of uniform amplitude and timing are directed to the solenoid so that the strike hammer can be held fixed in place until the end of the musical note.

An object of the invention is to accurately re-create recorded music on a solenoid actuated musical instrument.

Another object of the invention is to compensate for the impact of non-linear travel of solenoid plungers operating strike hammers in a player piano system.

Another object of the invention is to compensate for the impact of non-linear mass of piano keys on accurate music reproduction.

Another object of the invention is to compensate for the impact of noise dampers on accurate music reproduction.

Another object of the invention is to actuate solenoids in a player piano system with discrete data pulses which dynamically control the solenoid position during the entire strike time.

Another object of the invention is to maximize striking force with minimum power dissipation.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
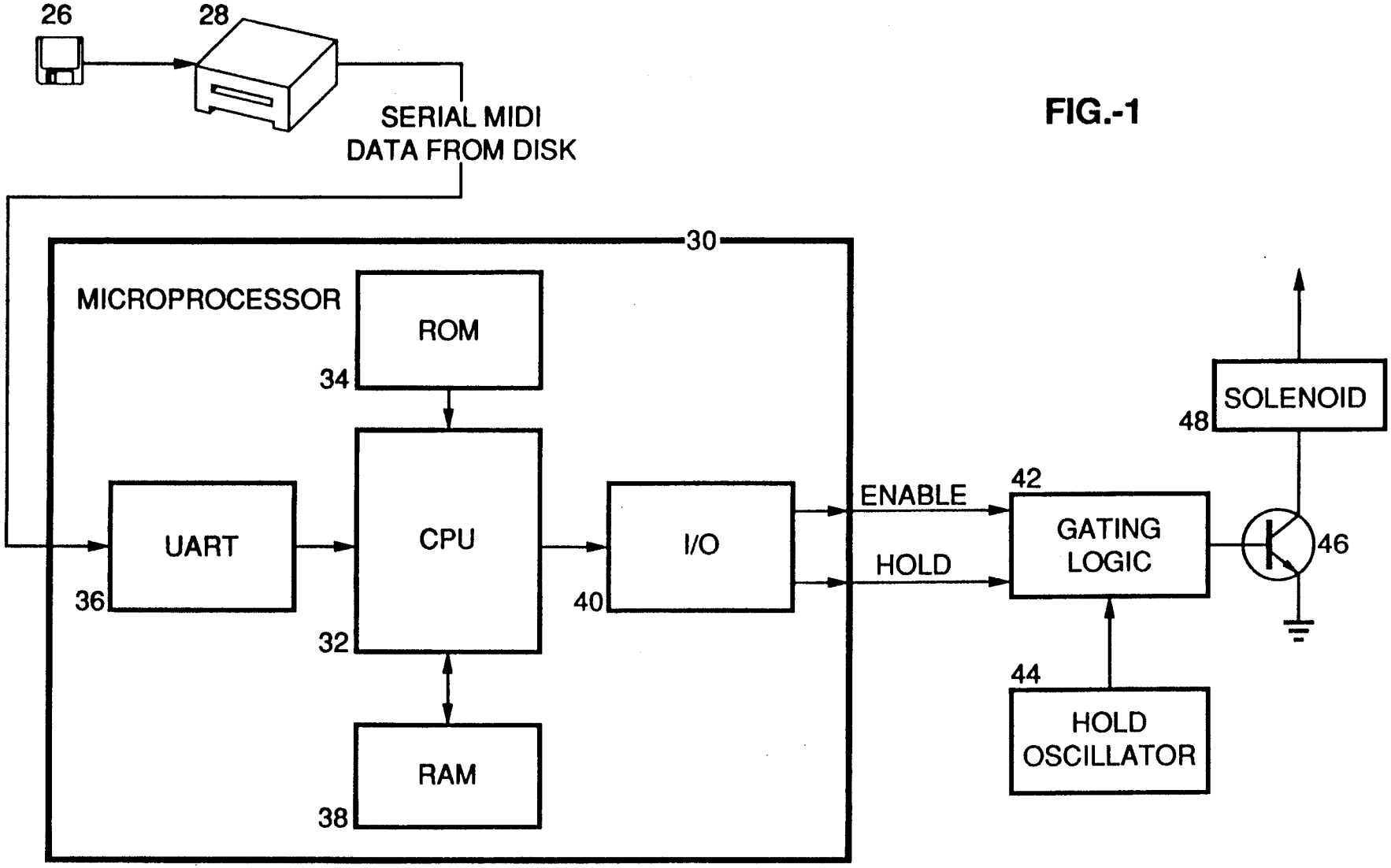
FIG. 1 is a functional block diagram of the apparatus of the present invention.

Referring more specifically to the drawings, for illustrative purposes the present invention is generally shown in FIG. 1 through FIG. 4. It will be appreciated that the present invention may vary as to the physical configuration and method of operation without departing from the basic concepts as disclosed herein.

The present invention utilizes musical information recorded on magnetic disk in the MIDI format; that is, Musical Instrument Digital Interface, which has become an industry standard. Once musical information is recorded in MIDI, the information can be manipulated by a computer using standard editing techniques. For example, sections of the music can be duplicated, bad notes can be corrected, and any other desired musical operation can be performed.

MIDI is a serial communications standard that provides a common language for the transmission of musical events in real time. The MIDI specification allows up to sixteen channels of information to be carried by a single cable, and each channel contains data about what notes are to be played, how loud they will be, what sounds will be used and how the music will be phrased. Contained within these data channels are velocity factors which are coded from 0 to 127, the highest velocity corresponding to the highest velocity factor. The present invention utilizes those velocity factors to accurately re-create the expression of the original recorded music on a solenoid actuated musical instrument such as a player piano system.

Referring to FIG. 1 through 4, recorded media 26 containing the music to be reproduced is read by playback unit 28. Coupled to playback unit 28 is control microprocessor 30 which selects the strike map for each driving signal 10 corresponding to a particular velocity factor. A core element of control microprocessor 30 is CPU 32, a central processor at the heart of the system. Coupled to CPU 32 is ROM 34, which contains in read only memory the strike maps for the various velocity factors as well as the operating software for CPU 32. Also coupled to CPU 32 is UART 36, a serial data receiver which receives the serial MIDI data from playback unit 28 and routes it to CPU 32. RAM 38, which contains changeable program data, is also coupled to CPU 32, as are drivers 40 which couple control microprocessor 30 to gating logic 42. Conventional circuitry and circuit elements are utilized throughout.

Control microprocessor 30 decodes the velocity factor from the recorded media 26 and assigns a particular driving signal 10 to that velocity factor. During the period of strike signal 12, control microprocessor 30 sends an enable signal to gating logic 42. Individual strike pulses 18 activate switch 46 which energizes solenoid 48 according to the strike map. At the end of strike signal 12, control microprocessor 30 switches gating logic 42 to accept hold signal 14 which consists of hold pulses 22 produced by hold oscillator 44.

Figure 2:
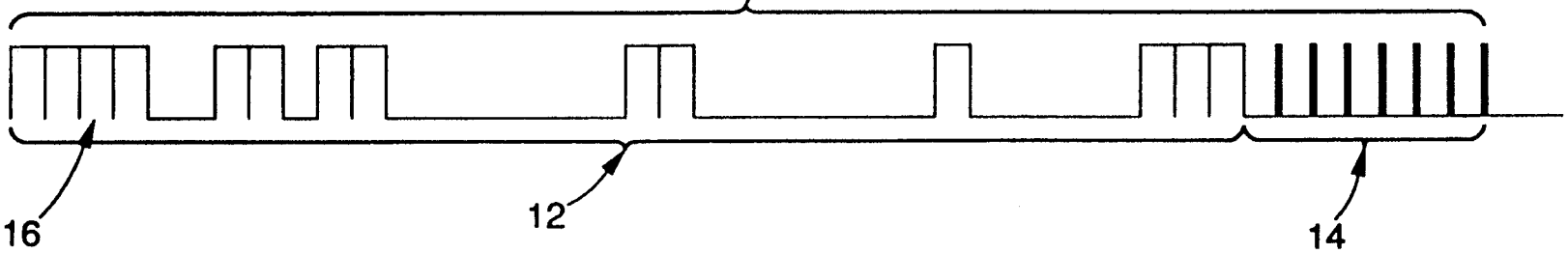
FIG. 2 is a timing diagram of a exemplary drive signal and strike map used in the method and apparatus of the present invention.

Referring now to FIG. 2, the apparatus reads a velocity factor from the recorded media and converts it into a corresponding driving signal 10. The duration of the driving signal 10 varies depending upon the velocity factor on the recorded media, but is typically in the range of approximately 20 to 150 milliseconds in duration. Therefore, there is a unique driving signal 10 for each velocity factor in the MIDI format.

The driving signal 10 is separated into two components; a strike signal 12 and a hold signal 14. Strike signal 12 is separated or "mapped" into discrete steps of time, or timing intervals 16 contained within a strike map. At each interval in the strike map, the solenoid is either switched on or off, an "on" signal reflected by the presence of a strike pulse 18 in a timing interval 16. It is the nature of this dynamic control achieves the objects of the present invention and overcomes the deficiencies of conventional pulse width modulation techniques. It can be noted, therefore, that the coding of the strike map is a vital part of the present invention. This coding can be accomplished by two methods; pre-determined and dynamic.

In the pre-determined method, a computerized analysis of the piano key interactions is made in a development lab. This analysis includes force of the solenoid, key mass, damper impact, and the interaction of other mechanical components. This analysis is then used to produce a set of strike maps for the control microprocessor 30 to use, there being one strike map for each velocity factor. The strike maps are then stored internally in ROM 34 and are not changed once the apparatus of the present invention is installed on the piano system. The control microprocessor 30, using the music velocity codes from the recorded media and any other programmed piano variables, determines which of the pre-determined strike maps to use. The solenoid is then driven according to the selected strike map.

The dynamic method is similar to the pre-determined method, but different in that the computerized analysis is performed within the actual piano system. This allows the piano system itself to generate the strike maps, the maps being unique to that particular piano system. To implement this method, feedback sensors are installed on the piano keys to measure the key response. Once the analysis is complete, the strike maps are stored in ROM 34.

Figure 3:
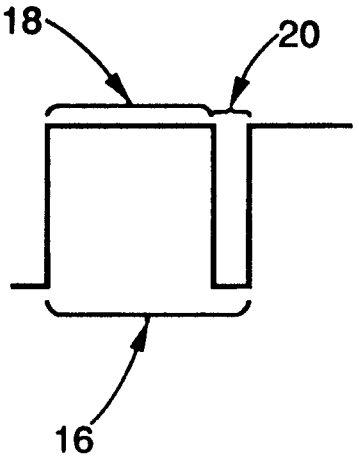
FIG. 3 is a timing diagram of a segment of the strike signal component of the timing diagram shown in FIG. 2.

Referring still to FIG. 2, a key strike which has an overall duration of one-hundred and twenty milliseconds would typically result in strike signal 12 being divided into fixed timing intervals 16 of two milliseconds each. Longer intervals are possible, but the loading on the control microprocessor will increase. As can be seen in FIG. 3, strike pulses 18 are square waves, their width and amplitude being fixed. Note that the width of strike pulses 18 are approximately ten microseconds shorter than timing interval 16, the difference being represented by rest interval 20. Whether an "on" state or strike pulse exists in a particular timing interval 16 is determined by the drive map developed for the particular velocity factor and key. FIG. 3 shows an "on" state for the particular timing interval 16 depicted.

Figure 4:
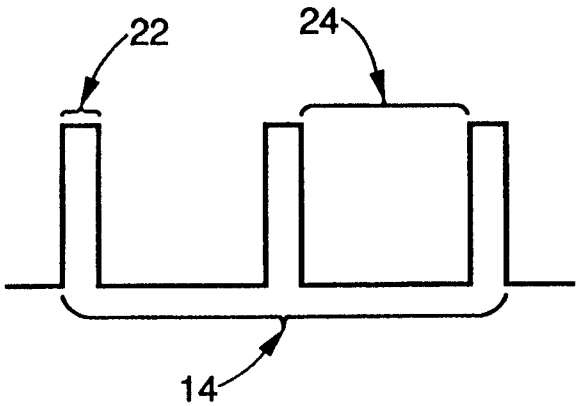
FIG. 4 is a timing diagram of a segment of the hold signal component of the timing diagram shown in FIG. 2.

Referring to FIG. 2 and FIG. 4, the hold signal 14 consists of a series of hold pulses 22 of uniform amplitude, width and timing. Typically the width of each hold pulse 22 is approximately fifteen microseconds, and hold pulses 22 are separated by rest intervals 24 which spaces hold pulses 22 approximately thirty-five microseconds apart for a frequency of approximately twenty kilohertz.

In operation, the strike pulses 18 in the strike signal 12 are applied to the solenoid according in accordance with the strike map. At the end of the strike signal 12, the solenoid is placed into a holding mode by applying the hold signal 14. The hold signal 14 persists until either the musical note is over, or the control microprocessor 30 times out so that the solenoid does not overheat and become damaged. Time-out is typically set to occur after ten to fifteen seconds.

Conventional pulse width modulation techniques heretofore developed can only provide a constant pulse stream to the solenoid and vary the width of those pulses so as to produce an "average power" strike for the solenoid. Therefore, they cannot accurately re-create the variations in the key strike of the original performance. It has been shown that the present invention, however, provides for dynamic control over the solenoid during its entire strike time, thereby accurately re-creating the key strike in the original performance, by mapping individual pulses into discrete time intervals, each pulse being of a fixed width and applying those mapped pulses to the actuating solenoid. Each pulse in the map is either on or off depending upon the amount of dynamic force required at each point in the solenoid strike time. Not only does this provide for accurate re-creation of expression effects, but also allows for a more economical design since the drive electronics only needs to produce pulses of one fixed width. In addition, since most electronic products must meet high standards for electrical noise generated within the product, a drive technique that produces only one frequency is easier to filter than a conventional pulse width modulation technique that produces pulses of varying widths and frequencies. Since in the present invention the solenoid is always driven with a pulse of exactly the same width, it is also possible to optimize the magnetic and electrical properties of the solenoid design to match the pulse width being used. This optimization reduces power consumption and increases system reliability over conventional pulse width modulation techniques wherein the solenoid and drive electronics must sustain a wide range of pulse durations.

Accordingly, it will be seen that this invention presents a unique and innovative solenoid drive technique, and allows for true re-creation of musical expression, lower costs of manufacture, better compliance with design standards, and increased reliability. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A method of reproducing expression effects on a musical note generating instrument with solenoid actuators, comprising the steps of:
   (a) converting the velocity factor component of musical information recorded in MIDI format into a solenoid strike signal, said strike signal including a plurality of time differentiated pulses of fixed width and amplitude, the number and timing of said time differentiated pulses in said strike signal being dependent upon the desired re-creation of the expression effect of a musical note;
   (b) applying said strike signal to a solenoid actuator corresponding to said musical note; and
   (c) applying a plurality of holding pulses of uniform amplitude and timing to said solenoid actuator until the end of said musical note, whereby the expression effect of said musical note is accurately reproduced on a solenoid actuated musical note producing instrument.

2. The method recited in claim 1, wherein said solenoid actuator is microprocessor controlled, the number and timing of said time differentiated pulses being selected by said microprocessor based on said velocity factor component.

3. The method recited in claim 2, wherein the width of said time differentiated pulses is approximately two milliseconds.

4. The method recited in claim 3, wherein the time between said time differentiated pulses is at least ten microseconds.

5. The method recited in claim 4, wherein the width of said holding pulses is approximately fifteen microseconds.

6. The method recited in claim 5, wherein the time between said holding pulses is approximately thirty-five microseconds.

7. An apparatus for reproducing expression effects on a musical note generating instrument with solenoid actuators, comprising:
   (a) means for converting the velocity factor component of musical information recorded in MIDI format into a solenoid strike signal, said strike signal including a plurality of time differentiated pulses of fixed width and amplitude, the number and timing of said time differentiated pulses in said strike signal being dependent upon the desired re-creation of the expression effect of a musical note;
   (b) means for applying said strike signal to a solenoid actuator corresponding to said musical note; and
   (c) means for applying a plurality of holding pulses of uniform amplitude and timing to said solenoid actuator until the end of said musical note, whereby the expression effect of said musical note is accurately reproduced on a solenoid actuated musical note producing instrument.

8. The apparatus recited in claim 7, wherein said solenoid actuator is microprocessor controlled, the number and timing of said time differentiated pulses being selected by said microprocessor based on said velocity factor component.

9. The apparatus recited in claim 8, wherein the width of said time differentiated pulses is approximately two milliseconds.

10. The apparatus recited in claim 9, wherein the time between said time differentiated pulses is at least ten microseconds.

11. The apparatus recited in claim 10, wherein the width of said holding pulses is approximately fifteen microseconds.

12. The apparatus recited in claim 11, wherein the time between said holding pulses is approximately thirty-five microseconds.

13. A pulse mapping process for re-creating the expression effects of musical notes recorded in MIDI format, comprising the steps of:
   (a) partitioning a solenoid strike period into a plurality of serial timing intervals;
   (b) mapping pulses into certain of said timing intervals to create a strike map, the number and timing of said time differentiated pulses being dependent upon the desired re-creation of the expression effect of a musical note, said time differentiated pulses being of fixed width and amplitude;
   (c) storing said strike map;
   (d) repeating steps (a) through (c) for a plurality of expression effects;
   (e) inputting a MIDI format velocity factor from recorded musical information;
   (f) selecting a strike map corresponding to said MIDI format velocity factor;
   (g) converting the pulse data contained in said strike map into a strike signal; and
   (h) applying said strike signal to a solenoid actuator corresponding to a musical note to be reproduced.

14. The method recited in claim 13, further comprising the step of applying a plurality of holding pulses of uniform amplitude and frequency to said solenoid actuator until the end of said musical note.

15. The method recited in claim 14, wherein the width of said holding pulses is approximately fifteen microseconds.

16. The method recited in claim 15, wherein the frequency of said holding pulses is approximately twenty kilohertz.

17. An pulse-map apparatus for re-creating the expression effects of musical notes recorded in MIDI format, comprising the steps of:
   (a) means for partitioning a solenoid strike period into a plurality of serial timing intervals;
   (b) means for mapping pulses into certain of said timing intervals to create a strike map, the number and timing of said time differentiated pulses being dependent upon the desired re-creation of the expression effect of a musical note, said time differentiated pulses being of fixed width and amplitude;
   (c) means for storing said strike map;
   (d) means for inputting a MIDI format velocity factor from recorded musical information;
   (e) means for selecting a strike map corresponding to said MIDI format velocity factor;
   (f) means for converting the pulse data contained in said strike map into a strike signal; and
   (g) means for applying said strike signal to a solenoid actuator corresponding to a musical note to be reproduced.

18. The apparatus recited in claim 17, further comprising means for applying a plurality of holding pulses of uniform amplitude and frequency to said solenoid actuator until the end of said musical note.

19. The apparatus recited in claim 18, wherein the width of said holding pulses is approximately fifteen microseconds.

20. The apparatus recited in claim 19, wherein the frequency of said holding pulses is approximately twenty kilohertz.

* * * * *